US006217397B1

(12) United States Patent
Brammer

(10) Patent No.: US 6,217,397 B1
(45) Date of Patent: Apr. 17, 2001

(54) CABLE CONNECTOR

(75) Inventor: Hartmut Brammer, Vaihingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/364,406

(22) Filed: Jul. 30, 1999

(30) Foreign Application Priority Data

Aug. 1, 1998 (DE) ..... 198 34 865

(51) Int. Cl.[7] ..... H01R 4/02

(52) U.S. Cl. ..... 439/874; 439/593

(58) Field of Search ..... 439/179, 736, 439/578, 874, 593; 174/84 R

(56) References Cited

U.S. PATENT DOCUMENTS

| | | | | |
|---|---|---|---|---|
| 2,845,516 | * | 7/1958 | Jones | 219/19 |
| 3,124,105 | * | 3/1964 | Massa | 339/60 |
| 3,372,476 | * | 3/1968 | Peiffer et al. | 29/628 |

* cited by examiner

*Primary Examiner*—Neil Abrams
*Assistant Examiner*—Phuong KT Dinh
(74) *Attorney, Agent, or Firm*—Kenyon & Kenyon

(57) ABSTRACT

An electric connector for producing a permanent, electrically conductive connection, includes a connector part and a male connector, with at least one conductive contact of the male connector being arranged in contact with a conductive contact of the connector part, and a fusion bond being provided between the two contacts, the connector part being designed so that it can also be used for detachable, electrically conductive connections, and the male connector having a molded body designed to fit the connector part.

30 Claims, 1 Drawing Sheet

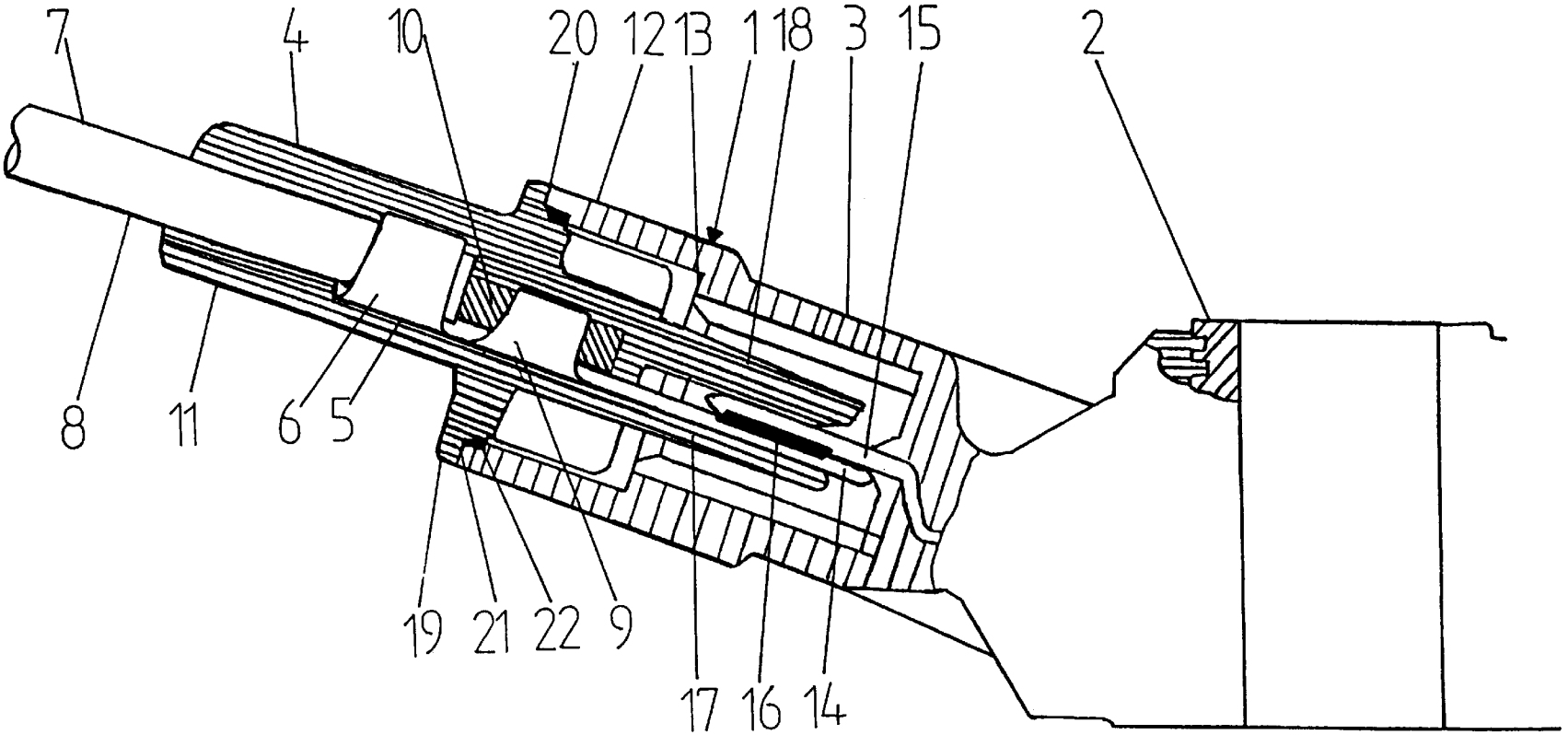
2
15
3
18
1
13
12
20
10
4
7
8
11
6
5
9
22
21
19
17
16
14

CABLE CONNECTOR

FIELD OF THE INVENTION

The present invention relates to an electric connector for creating a permanent, electrically conductive connection, having a connector part and a male connector, in which at least one conductive contact of the male connector is arranged on a conductive contact of the connector part and a fusion bond is provided between the two contacts. The present invention also relates to a method of producing the connector according to the present invention and its use according to the present invention.

BACKGROUND INFORMATION

Conventional detachable plug-in connectors include at least one connector part formed on a housing and into which a mating connector, connected to a conductor, can be inserted. Electronic components of the electric device are thus connected to other devices or to the power supply via the detachable plug-in connector and the conductor connected thereto. In particular in mass production, for example, in the automobile industry, it is often required that a detachable connection be provided in one application and that a permanent connection, which is secured by a fusion bond, i.e., a solder or weld, and can no longer be subsequently separated by removing the mating connector, be provided in another application.

In the conventional connectors, a connector part must be provided for the detachable electric connector and another connector part must be connected to the same housing for the permanent connector. This entails considerable expense, since different manufacturing methods and manufacturing tools are required for the alternative connectors in order to produce the different male connector geometries.

SUMMARY OF THE INVENTION

An object of the present invention is to improve the electric connector so that a connector part that is permanently connected to a device housing is suitable for both a detachable and a permanent electric connection without necessitating the formation of separate connector parts on the device housing.

This object is achieved according to the present invention concerning an electric connector by designing a permanently connectable connector part, for example, so that it can also be used for a detachable electrically conductive connection, and the male connector having a molded body designed to fit the connector part.

It has been recognized according to the present invention that the same connector part can be used for a detachable connection and for a permanent fused bond. The connector part, which is designed to have standard geometry featuring tabs, can be assembled as a detachable, electrically conductive connection. To produce the permanent electrically conductive connection, only the mating connector is replaced by the male connector according to the present invention, which is insertable into the connector part and whose molded body is designed to fit the geometry of the connector part. Thus, the male connector can be advantageously inserted in the connector part, so that the contact of the male connector is on the contact of the connector part and then a permanent bond can be created between the two contacts using a special fusing method.

The decisive advantage of the electric connector according to the present invention is that a single connector part, which is mechanically attached to the device housing, can be used for the different connector versions. Different electric connectors can be obtained simply by using a conventional mating connector for the detachable connection and a male connector for the permanent connection. Since the same connector part is molded or formed on the device housing for the different connectors, considerable cost savings can be achieved. In the context of the present invention, the term permanent means a connection that can only be separated by destroying the fused bond, for example, at very high temperatures.

The connector part is preferably mechanically attached to the device housing. The connector part can be a standard component with tabs having standard geometry. Thus, a uniform basic body composed of the device housing and the connector part is obtained, i.e., a cost-effective version for fully automatic manufacturing. The design of the connector versions is obtained by a separate plastic injection process to produce the male connectors to fit the connector part. The contacts of the male connector are then borded to the contacts of the connector part using a special fusion bond.

In a particularly advantageous embodiment according to the present invention, the connector part has a receptacle, into which the mating connector of the detachable connection, in particular, a plug and socket, clamp or threaded connection, can be inserted. This receptacle can have a predefined standard geometry for large-scale manufacture. The male connector can then be inserted in this receptacle to form the permanent fusion bond. The male connector, connected to a conductor, for example, a cable, is initially simply inserted in the receptacle and is held fast there in a form-fitting manner.

The receptacle is preferably designed as a socket, in particular, with an annular shoulder as a stop for the mating connector or the male connector. Thus, the male connector is in a fixed position within the connector part prior to the fusion bonding procedure and a seal can be provided on the annular shoulder in order to protect the conductors within the electric connector from environmental influences.

The actual electric contact of the male connector can be designed as a plug and socket contact or as a contact socket. Distinction should be made between the receptacle designed as a socket, which can be made of plastic and can be brought into engagement with the molded body of the male connector, and the metal contact of the connector part, which can be designed as a plug-in connector or as a contact socket.

The contact of the male connector is preferably designed as a cable clamp contact, on which a conductor, in particular, a cable, can be fixedly clamped prior to fusion bonding. The cable clamp contact can be provided with a tab at one end, and with at least one clip to secure the conductor, in particular, the cable, at the other end. The cable is then preferably secured at the cable clamp contact using the clip, and the other end of the cable clamp contact projecting from the molded body of the male connector or freely positioned there is provided as a tab to engage with the contact of the connector part.

The male connector has a molded body made, in particular, of plastic, which fits the receptacle of the connector part. The molded body is advantageously produced by injecting plastic around the cable connected to the cable clamp contact, using an injection mold allowing a molded body fitting the connector part to be produced.

In a particularly advantageous embodiment according to the present invention, the molded body has one or more support elements, which press the contact of the connector part against the contact of the male connector. For this purpose, the contact of the male connector can be arranged on a plastic projection, and a support element positioned opposite the contact and separated from it by a small distance can be provided, so that the contact of the connector part can be inserted and pressed between the contact and the plastic projection. In either case, standard contacts can also be used.

The molded body preferably has a stop, in particular, an annular shoulder, for limiting movement. The annular shoulder can be in close contact with another annular shoulder or edge of the contact part receptacle, forming a seal in particular.

A conductor or a cable is preferably connected to the cable element. The cable element, in turn, is connected to the connector part via a fusion bond. A weld or a solder is provided as a fusion bond. Induction or reflow soldering is advantageously used for soldering.

An object of the present invention concerning a method is also achieved, for example, by providing a method of producing a permanent, electrically conductive connection, in which a cable or conductor is connected to a contact of a male connector, the male connector being brought into engagement with a receptacle of a connector part that is suitable for use in a detachable connection, and in which a fusion bond is created between the contact of the male connector and a contact of the connector part.

In the method according to the present invention, the male connector is brought into engagement with the connector part as in the case of a detachable connection, and a fusion bond is created as a final step. Both a detachable and a permanent connection can be provided without modifying the device housing with the connector part formed on it. A cable can be clamped or soldered to a contact of the male connector in a simple manner for a permanent connection, and the male connector is inserted into the connector part so that subsequently a fusion bond can be produced between the contact of the male connector and the contact of the connector part.

The male connector can be produced by plastic injection around a conductor, in particular, a cable, connected to a contact. The cable is initially attached to the contact and secured in a mold or on a jig for plastic injection. The male connector molded body produced by plastic injection can be adapted to the given requirements, i.e., to the shape of the connector part receptacle. The functions of the molded body include providing a mechanically sealing connection between the two parts of the electric connector, securing the cable with the cable clamp contact within the mold, and then pressing the contact of the connector part onto the contact of the male connector.

After the contacts have been pressed together, they can be connected, in particular soldered, using induction heating. The male connector is previously inserted into the connector part along the longitudinal axis, so that the electric connector can assume its final position upon contact. The permanent connection can be produced by a fusion process, for example.

The molded body preferably produces a pressing force between the contacts of the connector part and of the male connector during the fusion of the two contacts, so that an accurate fusion bond can be obtained.

Finally, the molded body of the male connector can also be connected to the receptacle of the connector part using ultrasonic welding. This produces a weather-proof connection that is also resistant to strong vibrations.

Ultrasonic treatment allows reflow soldering to be performed without protective gas, since oxide layers in the contact metal are broken up. This prepares the contacts for soldering, obviating the need for direct surface treatment or mechanical machining of the contacts.

An object of the present invention with respect to using an electric connector is achieved by providing the use of an electric connector that has a connector part with at least one electrically conductive contact and a receptacle for a mating connector to obtain a detachable, electrically conductive connection, together with a corresponding male connector as a permanent, electrically conductive connector, the connector part and the male connector being permanently bonded together after being plugged into one another.

It has been recognized according to the present invention that the use of an electric connector having the same connector part to produce a detachable connection with a mating connector and to produce a permanent connection with the male connector results in substantial savings in manufacturing costs, since the same connector part connected to the housing can be used for all electric connector variants.

The connector part has a cable clamp, which is also welded or soldered to the cable. The cable clamp is also soldered to the connector part contact and arranged within the plastic molded body by molding or injection.

The cable sheath or the molded body is advantageously soldered to the connector part. This reduces the tensile forces acting on the cable and provides a tight connection between cable, male connector and connector part.

The contact of the connector part is preferably a tab, which can be used in a simple manner for both detachable and permanent connections. Both the mating connector of the detachable connection and the male connector of the permanent connection are simply pushed onto the tab; the molded body, with its support element, presses the tab onto the male connector contact, so that a fusion bond is easily produced.

BRIEF DESCRIPTION OF THE DRAWING

The FIGURE schematically shows an electric connector for creating a permanent, electrically conductive connection according to the present invention.

DETAILED DESCRIPTION

Connector 1, shown in the FIGURE, has a connector part 3, attached to a housing 2 of an electric device.

A male connector 4 is provided to engage with connector part 3. Male connector 4 has a cable clamp contact 5 with large clips 6 for cable sheath 7 of a cable 8 and two small clips 9 for strand 10 of cable 8. Both cable sheath 7 and strand 10 of cable 8 are securely clamped between clips 6, 9 in cable clamp contact 5. A molded body 11 made of plastic is arranged around cable clamp contact 5 and cable 8. Molded body 11 is produced by injecting plastic around cable clamp contact 5. A shape that is suitable for receptacle 12 of connector part 3 is obtained using a special injection mold or a special jig.

Receptacle 12 is designed as a socket with annular shoulder 13, which serves to limit the movement of the mating connector in the case of a detachable connection. Male connector 4 engages in the center of receptacle 12 and one end, designed as a tab 14, of cable clamp contact 5 is in lateral contact with a metal contact 15 of connector part 3. A high-frequency solder, i.e., a reflow solder 16 is provided between metal contact 15 and tab 14. Thus, tab 14 of male connector 4 and metal contact 15 of connector part 3 are permanently connected.

To produce pressing force, two support elements 17 and 18 are formed on both sides of tab 14, which press metal contact 1 of the connector part onto tab 14. Support element 18 is arranged at a distance from tab 14, so that metal contact 15 of connector part 3 can be clamped between them in order to facilitate fusion bonding, i.e., reflow soldering.

Molded body 11 has a peripheral collar 19 with an annular shoulder 20, which sealingly fits a peripheral rim 21 of receptacle 12. Peripheral collar 19 is used to position, and limit the movement of, male connector 4 within receptacle 12 of connector part 3 and also to form a seal protecting the inside of electric connector 1.

Peripheral rim 21 of peripheral collar 19 is permanently bonded by an ultrasonic weld 22.

The electric connector according to the present invention can, of course, be manufactured with any geometry and is not limited to the geometry of any specific embodiment. In particular, molded body 11 may have a polygonal or oval cross section instead of a circular cross section. Shoulder 20 is then adapted so that it forms a sealing stop for the plug. In particular, shoulder 20 can also have an oval or polygonal design.

What is claimed is:

1. An electric connector for producing a permanent, electrically conductive connection, comprising:

a connector part having a conductive contact, the connector part being designed for use in a detachable, electrically conductive connection;

a male connector having at least one conductive contact and a molded body having a support element, the at least one conductive contact of the male connector being arranged in contact with the conductive contact of the connector part, the molded body being designed to fit with the connector part, the support element pressing the conductive contact of the connector part against the conductive contact of the male connector; and a fusion bond being provided between the at least one conductive contact of the male connector and the conductive contact of the connector part.

2. The electric connector according to claim 1, wherein the connector part is mechanically attached to a device housing.

3. The electric connector according to claim 1, wherein the connector part has a receptacle, in which a mating connector of the detachable, electrically conductive connection can be inserted.

4. The electric connector according to claim 3, wherein the detachable, electrically conductive connection includes at least one of a plug-and-socket connection, a clamp connection and a threaded connection.

5. The electric connector according to claim 3, wherein the male connector is placed in the receptacle, and wherein the fusion bond is permanent.

6. The electric connector according to claim 3, wherein the male connector is inserted in the receptacle, and wherein the fusion bond is permanent.

7. The electric connector according to claim 3, wherein the receptacle is designed as a socket.

8. The electric connector according to claim 7, wherein the socket includes an annular shoulder for use as a stop for at least one of the mating connector and the male connector.

9. The electric connector according to claim 1, wherein the at least one conductive contact of the male connector is designed as at least one of a plug-and-socket contact and a contact socket.

10. The electric connector according to claim 9, wherein the at least one conductive contact of the male connector includes at least one contact clip in lateral contact with the conductive contact of the connector part.

11. The electric connector according to claim 1, wherein the at least once conductive contact of the male connector is designed as a cable clamp contact on which a conductor is securely clamped prior to fusion bonding.

12. The electric connector according to claim 11, wherein the conductor includes a cable.

13. The electric connector according to claim 11, wherein the cable clamp contact includes a tab disposed at a first end and at least one clip disposed at a second end, the at least one clip for securing the conductor.

14. The electric connector according to claim 12, wherein the cable clamp contact includes a tab disposed at a first end and at least one clip disposed at a second end, the at least one clip for securing the cable.

15. The electric connector according to claim 1, wherein the molded body fits a receptacle of the connector part.

16. The electric connector according to claim 15, wherein the molded body includes a plastic material.

17. The connector according to claim 15, wherein a movement-limiting stop is formed on the molded body.

18. The electric connector according to claim 17, wherein the movement-limiting stop includes an annular shoulder.

19. The electric connector according to claim 15, wherein the molded body includes an annular shoulder, the annular shoulder being in sealing contact with at least one of an annular shoulder of the receptacle of the connector part and a rim of the receptacle of the connector part.

20. The electric connector according to claim 1, wherein the male connector is designed as a cable clamp contact, the cable clamp contact being connected to at least one of a conductor and a cable, the cable clamp contact being connected via the fusion bond to the conductive contact of the connector part.

21. The electric connector according to claim 1, wherein the fusion bond is at least one of a weld and a solder.

22. A method for producing a permanent, electrically conductive connection, comprising the steps of:

connecting at least one of a cable and a conductor to a contact of a male connector;

engaging the male connector with a receptacle of a connector part, the connector part being suitable for a detachable connection;

pressing together the contact of the male connector with a contact of the connector part via a support element of a molded body of the male connector; and producing a fusion bond between the contact of the male connector and a the contact of the connector part.

23. The method according to claim 22, wherein the male connector is produced by plastic injection around the at least one of the cable and the conductor.

24. The method according to claim 22, wherein the step of engaging includes the steps of:

inserting the male connector into the connector part; and connecting via induction heating the contact of the male connector to the contact of the connector part.

25. The method according to claim 22, wherein the step of engaging includes the step of connecting a molded body of the male connector to the receptacle of the connector part using ultrasonic welding.

26. The method according to claim 22, wherein the step of producing includes the step of treating with ultrasound allowing reflow soldering without a protective gas.

27. An electric connector for use as a permanent, electrically conductive connector, comprising:

a male connector having at least one conductive contact and a molded body having a support element; and a connector part including at least one electrically conductive contact and a receptacle for mating with the male connector to produce a detachable, electrically conductive connection, the at least one conductive contact of the male connector being arranged in contact with the conductive contact of the connector part, the molded body being designed to fit with the connector part, the support element pressing the conductive contact of the connector part against the conductive contact of the male connector, the connector part and the male connector being permanently bonded together after being plugged into one another.

28. The electric connector according to claim 27, wherein the connector part and the male connector each includes contacts, the contacts being at least one of welded and soldered.

29. The electric connector according to claim 27, wherein the male connector includes at least one of a cable sheath and a molded body, the at least one of the cable sheath and the molded body being welded to the connector part.

30. The electric connector according to claim 27, wherein the contact of the connector part includes a tab.

* * * * *